United States Patent [19]

Cho

[11] Patent Number: 4,984,300

[45] Date of Patent: Jan. 15, 1991

[54] PROTECTIVE GLOVE

[75] Inventor: Soo Se Cho, Roseland, Fla.

[73] Assignee: Macho Products, Inc., Palm Bay, Fla.

[21] Appl. No.: 347,670

[22] Filed: May 5, 1989

[51] Int. Cl.[5] ..... A41D 13/10

[52] U.S. Cl. ..... 2/18; 2/16; 2/161 A

[58] Field of Search ..... 2/16, 18, 20, 161 A, 2/158, 159, 160

[56] References Cited

U.S. PATENT DOCUMENTS

| | | | |
|---|---|---|---|
| D. 255,393 | 6/1980 | Sugibayashi | D 2/231 |
| 961,149 | 6/1910 | Maynard | 2/18 |
| 1,627,382 | 5/1927 | Golomb | 2/18 |
| 2,322,710 | 6/1943 | Eisendrath | 2/20 |
| 2,574,086 | 11/1951 | Broderick | 2/18 |
| 3,855,633 | 12/1974 | Rhee | 2/18 |
| 3,903,546 | 9/1975 | Rhee | 2/16 |
| 3,924,272 | 12/1975 | Allen et al. | 2/16 |
| 3,945,045 | 3/1976 | Rhee | 2/16 |
| 4,062,073 | 12/1977 | Rhee | 2/16 |
| 4,287,610 | 9/1981 | Rhee | 2/18 |
| 4,290,147 | 9/1981 | Brückner et al. | 2/18 |
| 4,400,829 | 8/1983 | Willis | 2/16 |
| 4,411,024 | 10/1983 | Hayes | 2/20 |
| 4,417,359 | 11/1983 | Johnson | 2/161 |
| 4,635,300 | 1/1987 | Rhee | 2/16 |

*Primary Examiner*—Werner H. Schroeder
*Assistant Examiner*—Sara M. Current
*Attorney, Agent, or Firm*—Duckworth, Allen, Dyer & Doppelt

[57] ABSTRACT

A protective glove of flexible, resilient foam material has a rear portion partially encircling the wrist and held thereto by a releasable circumferential elastic strap and a front portion, including a knuckle covering thickened portion and a downwardly extending finger covering portion, held in place by a laterally extending palm strap. The inside surface of the finger portion includes a ladder-like member having first and second elongated laterally extending bands joined at intermediate points by three cross-member bands which define two loops through which second and third fingers pass to draw the front and rear portions together to tighten the glove when making a fist. One band is attached to the glove to form an integral part of the inner surface of the finger portion, and has ends extending beyond the cross-members. The other band is raised above the inner surface and has free floating end appendages beyond the cross-member junctures which assist in grasping and distribution of glove tightening forces.

16 Claims, 2 Drawing Sheets

PROTECTIVE GLOVE

This invention relates to a protective glove adapted to fit over and cover the back of the wrist and hand, including the fingers, of a wearer to protect from injury in the art of karate and the like.

BACKGROUND OF THE INVENTION

While practicing or competing in martial arts activities such as karate, one participant uses open hands and fists to inflict blows upon the other participant's body and head. These blows may result in an unintentional injury unless, of course, the force of the blow is lessened prior to physical contact. Such lessening may be achieved by the participants either wearing protective gear or by delivering less than full blows, i.e. pulling punches. During karate contests, points are scored for the nature and number of blows delivered. Consequently, spectator appeal of the sport as well as a test of participants' skills would be reduced if the delivery of the blows had to be restricted in order to avoid injury. Additionally, the benefits of practicing would be minimized if blows could not be fully delivered. Protective gear is, thus, the preferred solution.

In an attempt to provide effective protection for the participants, a number of protective glove devices have been designed and are available commercially. To achieve the primary objective of safety, any such device must afford protection to the wearer, yet permit freedom of movement so that the wearer may effectively participate in the activity as intended. Because of the strenuous activity by the wearer while using any such protective device, it must be lightweight and preferably cover only those areas requiring protection so as to minimize any weight burden while permitting maximum ventilation.

Typical devices designed in an effort to achieve these objectives are described in the patent literature exemplified by U.S. Pat. Nos. Des.255,393; 3,855,633; 3,945,045; and 4,417,359. Preferred forms of such devices provide protection while permitting the hand sufficient freedom of movement to be able to deliver both blows, such as knifehand blows (commonly called "chops"), in an open hand, finger extended position with the side of the hand acting as the point of contact and blows in a closed hand, fist position with the knuckles and the backs of the fingers between the knuckles and first joints (proximal phalanges) acting as the point of contact. Such gloves usually have a rear portion to protect and attach to the wrist and a front portion to cover the back of the hand and fingers. The front portion may be held in place by a strap extending across the palm, and one or more loops may be provided through which the fingers extend to draw the inside of the front portion toward the rear portion to maintain close contact with the back of the fingers and tighten the glove when the hand is closed into a fist. Side and thumb portions are often provided to protect the blade side of the hand and thumb, and it is common to thicken the glove in the region that will cover the knuckles and proximal phalanges when the glove is drawn in on the fist.

The loops on the inner surface of the front portions of prior art karate protective gloves have been found to interfere with the forming of the fist by either unnecessarily confining the fingers or by nonuniformally influencing the closing of the hand or drawing in of the glove. A typical arrangement for drawing the glove in tightly in making the fist utilizes a single loop formed by a laterally extending strip connected at each of its ends to the inner surface of the front portion of the glove and through which two or more fingers extend as shown in the '633. '045 and '359 patents. The '393 patent shows an arrangement in which the strip is also connected to the inner surface at intermediate points to provide four separate loops through which each individual finger is passed. The loop or loops are typically arranged to extend across the fronts of the fingers between the second and third joints (middle phalanges).

In arrangements, such as shown in the '393 patent, in which all four fingers are separately looped, the first and fourth fingers (index and little fingers) are unduly restricted and the strip is connected adjacent the lateral edges of the glove, thereby providing protrusions that could potentially inadvertently cause injury by scraping an eye, etc. and requiring that the edges of the glove be drawn inwardly and centrally with the fingers when the fist is closed. Arrangements in which only the second and third fingers (middle and ring fingers) are looped avoid the undesirable lateral edge glove connection but interfere with uniformly closing the fist because only two of the fingers close around the strip and only those two fingers experience the force that draws the glove around the fist. Moreover, the parts of the strip that connect to the inner surface and run alongside the fingers are pulled inwardly and centrally at an angle, along a direction tending to tear the strip away from the inner surface.

It is an object of the present invention to overcome these and other disadvantages of the prior art protective gloves through improvements thereto, and especially improvements to the means gripped by the fingers to draw the gloves in tightly against the back of the hand and fingers when a fist is made.

SUMMARY OF THE INVENTION

The present invention provides a protective glove adapted to fit over and cover the back of the wrist and hand, including the fingers, of a wearer to protect from injury in the art of karate and the like which has a rear portion to protect the wrist, a front portion to protect the back of the hand and fingers, and improved means located at the inner surface of the front portion through which the fingers extend to draw the front portion in toward the rear portion when a fist is made.

A glove in accordance with the invention preferably comprises a flexible, unitarily molded, resilient foam member. The rear portion includes a wrist portion which partially surrounds the wrist and is open at the inner wrist. The front portion includes a thickened portion adapted to cover the knuckles and a downwardly extending finger portion adapted to cover at least the base of the fingers when the hand is in a finger extended position. The front portion also has a side portion to cover the blade side of the hand and a strap connected from the side portion transversely of the inner surface of the front portion and arranged to extend across the palm to hold the front portion to the hand.

The improved means to draw the front portion toward the rear portion when a fist is made includes an elongated, laterally extending gripping member having unconnected, free floating ends and a plurality of stringers connecting laterally spaced intermediate points of the gripping member to the inner surface of the front portion, with the means being adapted to be grasped with the gripping member extending across the front of the fingers and the stringers extending between adjacent fingers. The unconnected free ends of the gripping member project as appendages laterally beyond the stringers and serve to assist advantageously in forming a uniform fist by extending the lateral dimension of the gripping member across the fronts of all the fingers, without providing an undesirable connection of the gripping member to the glove on the outsides of the first and fourth fingers.

In its preferred form, the means for drawing the glove into a fist has a laterally disposed ladder-like structure with first and second parallel, flat, elongated bands spaced from each other and connected at intermediate points by three perpendicularly extending elongated, flat cross-bands, the first band being attached to and forming a part of the inner surface of the finger portion of the glove and the second band being raised up in elevated position from the inner surface by the cross-members. The ladder-like structure is arranged, configured and adapted so that the second and third fingers of the wearer extend through the two loops defined between the first and second bands and the cross-members, with the raised band extending across the front of the fingers at the middle phalanges.

BRIEF DESCRIPTION OF THE DRAWINGS

Embodiments of the invention have been chosen for purposes of illustration and description, and shown in the accompanying drawings, wherein.

Throughout the drawings, like elements are referred to by like numerals.

DESCRIPTION OF THE PREFERRED EMBODIMENTS

Figure 1:
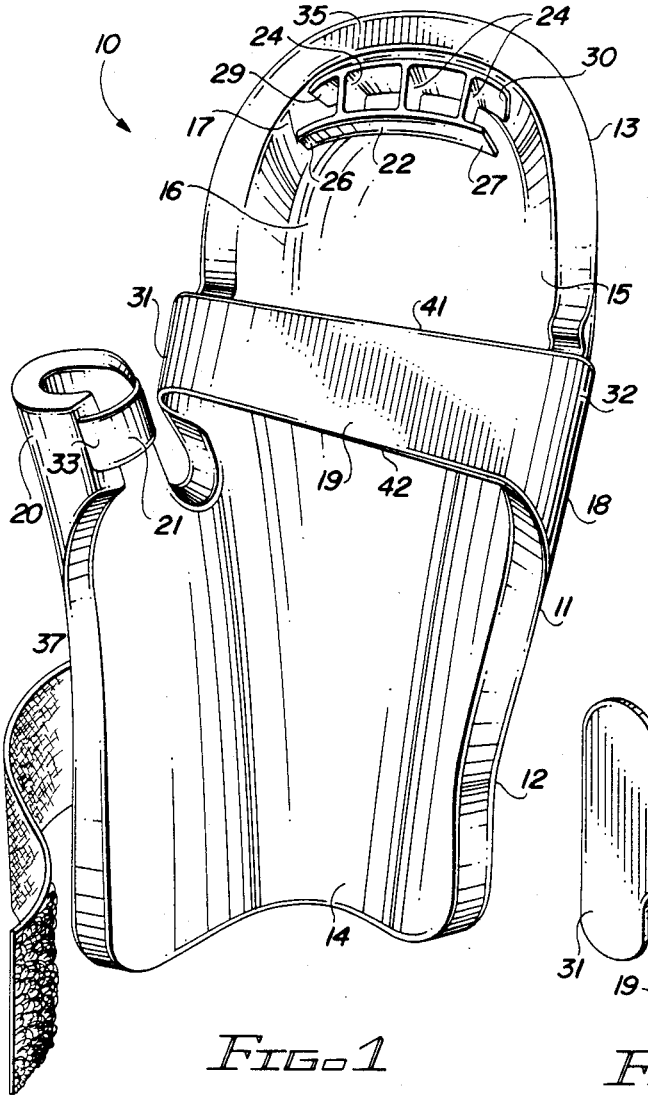
FIG. 1 is a perspective view of a protective glove in accordance with the invention, showing the inner surface thereof.
Figure 2:
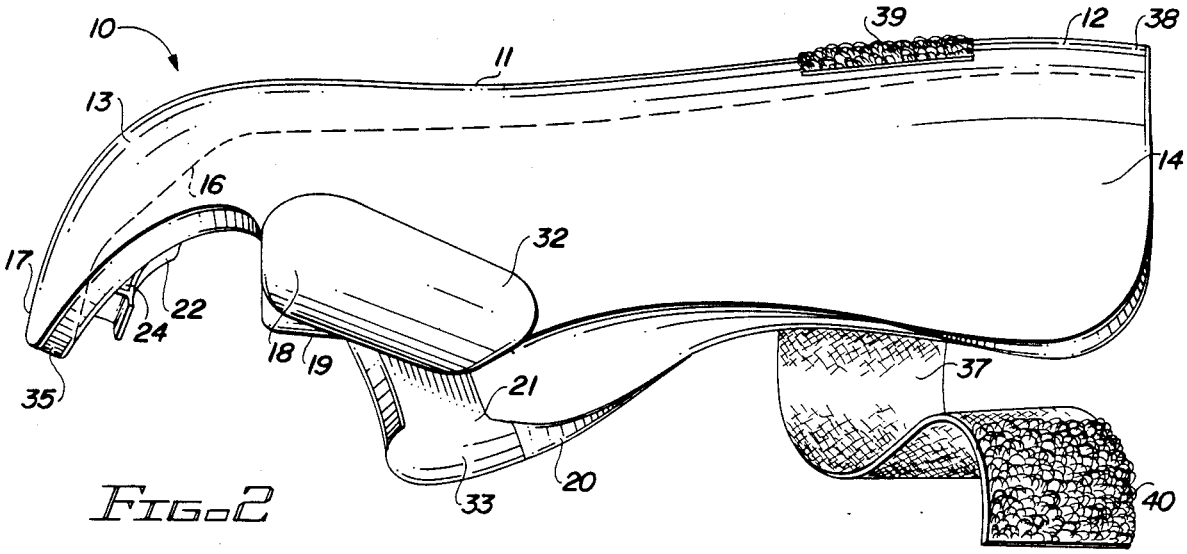
FIG. 2 is a side elevation view of the glove of FIG. 1.

The principles of the invention are illustrated, by way of example, embodied in the form of a protective glove 10 shown in FIGS. 1 and 2 having a flexible, unitarily molded, resilient foam member 11, generally comprising a rear portion 12 and a front portion 13. The rear portion 12 includes a tubular wrist portion 14 adapted to fit over and partially surround the wrist of a hand inserted in the glove (see FIGS. 6 and 7), open to leave the inner wrist uncovered. The front portion 13 of the glove 10 has an open inner surface 15 generally contoured to match the back of the hand and fingers and includes a thickened central portion 16 (indicated in FIG. 1 and by dashed lines in FIG. 2) adapted to cover the knuckles and proximal phalanges when the glove is drawn into the closed hand, fist position, shown in FIG. 7. The front portion 13 also includes a finger portion 17 that extends downwardly from a forward part of the thickened portion 16. The finger portion 17 is adapted to cover at least the bases of the backs of the fingers when the hand is placed in the glove in the open hand, finger position shown in FIG. 6. The front portion 13 also includes a side portion 18 extending downwardly at the non-thumb side of the glove 10 adapted to cover the blade side of the hand, which is the point of contact for the application of chopping blows.

Figure 4:
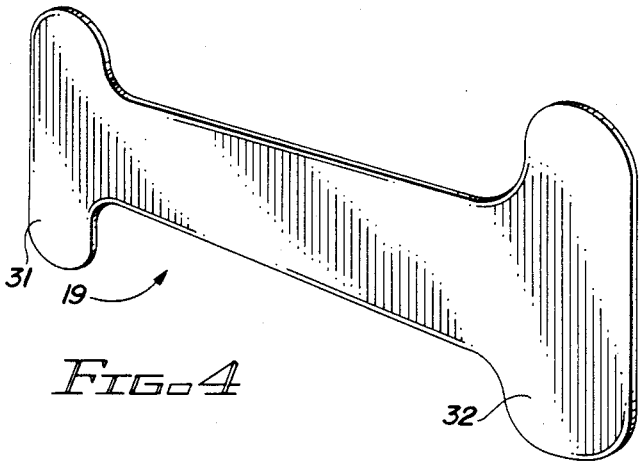
FIG. 4 is a view of the palm strap element.
Figures 6, 7, 8:
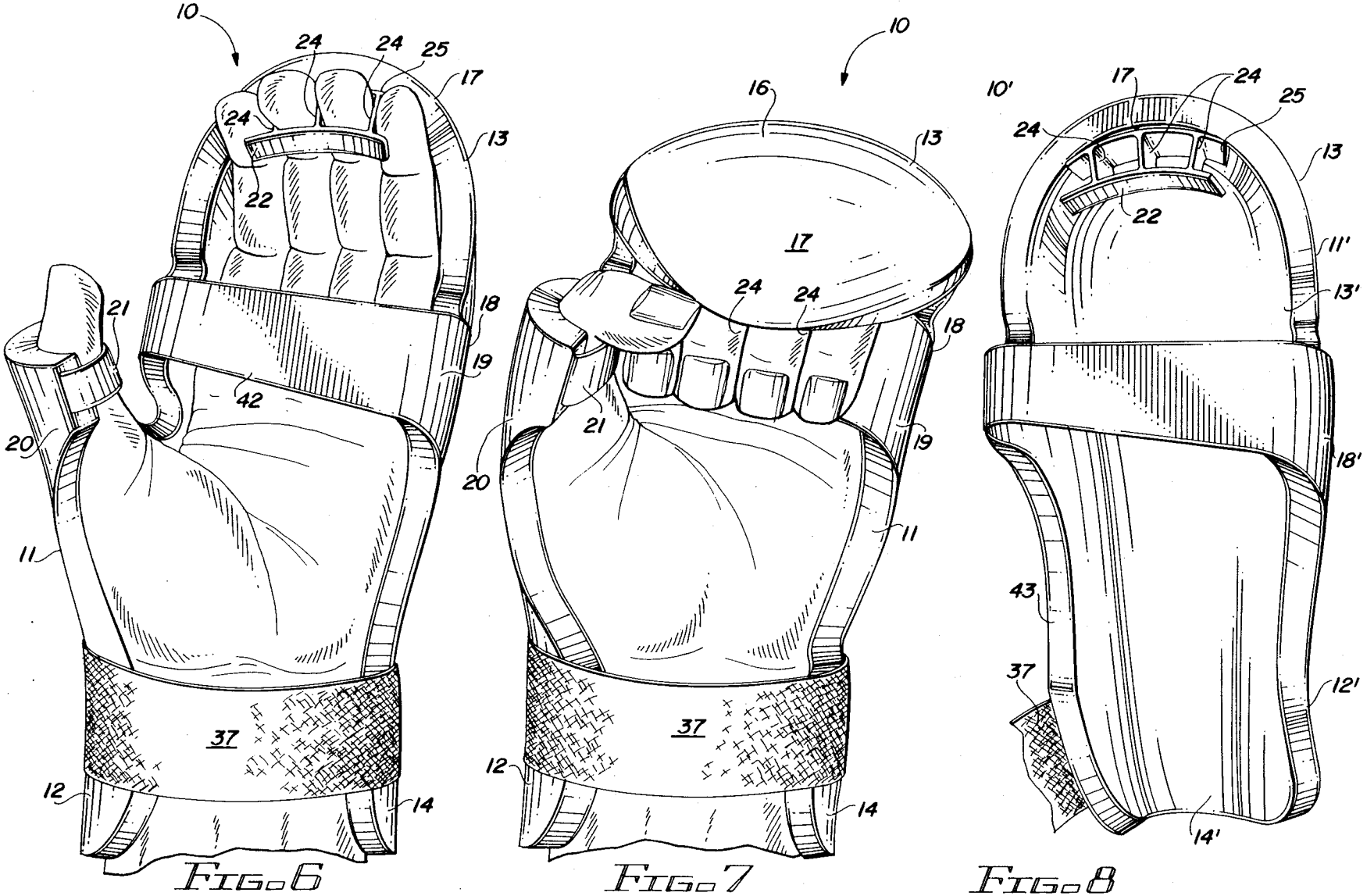
FIGS. 6 and 7 are views useful in understanding the operation of the glove of FIGS. 1 and 2.
FIG. 8 is a view as in FIG. 1 of a modified form of the glove of the invention.

A tapered, flat web or strap 19, shown in FIG. 4, is connected to the side portion 18 and across the front portion 13 of the inner surface 15 to the other side of the glove 10. The strap 19 is arranged, as seen in FIGS. 6 and 7, to extend across an upper palm portion between the thumb and fingers of the inserted hand and serves to secure and retain the front portion 13 to the hand.

Figure 5:
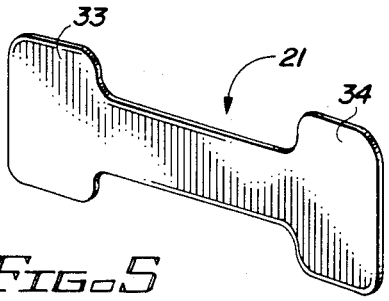
FIG. 5 is a view of the thumb strap.

The embodiment of glove 10 shown in FIGS. 1 and 2 also includes a thumb portion 20 of tubular shape adapted to partially surround and cover the back of the thumb, leaving the front of the thumb open. A thumb strap 21, shown in FIG. 5, is connected across the inside of the thumb portion 20 to extend across the front of the proximal phalanx of the thumb to secure and retain the thumb portion 20 to the thumb.

Figure 3:
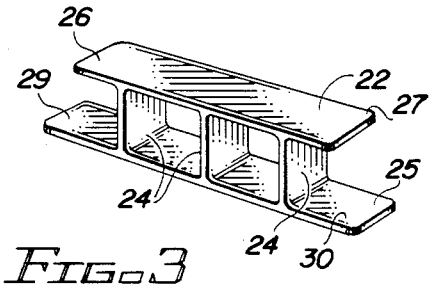
FIG. 3 is a view of the finger grip portion of the glove.

In accordance with the invention, means are located on the inner surface 15 of the finger portion 17 to grip the portion 17 for drawing the front portion 12 toward the rear portion 12 to tighten the glove 10 about the hand when the fingers are curled to make a fist. The gripping means comprises an elongated, laterally extending gripping member which may take the form of a flat band 22 adapted to fit within the closed hand across the fronts of the middle phalanges of all four fingers. Stringers which may take the form of a plurality of preferably three flat cross-members 24 connect laterally spaced points intermediate the ends of the band 22 to the inner surface 15 at the finger portion 17. The preferred gripping means is a laterally disposed ladder-like structure, as shown in FIG. 3, wherein the cross-members 24 connect to the portion 17 through the intermediary of a base member in the form of an elongated flat band 25 that extends laterally in spaced parallel relationship to the raised band 22. The opposite ends 26, 27 (see FIGS. 1 and 3) of the band 22 are left unconnected, as free floating appendages extending in opposite directions beyond the outermost points of connection of the cross-members 24 to the band 22. In like manner, the opposite ends 29, 30 of the base band 25 also preferably extend in opposite directions beyond the outermost points of connection with the cross-members 24—the entire length of the distal face of the band 25 being, however, secured to the inner surface 15 of the front portion 13 to form an integral part of the glove 10.

The shown gripping band 22 is a thin member of uniform width (dimension parallel to the length of the fingers) and has a length to extend generally laterally across the glove 10 from the middle of the front of the first finger through the middle of the front of the fourth finger, the length of the appendages 26, 27 being generally one-half the width of the first and fourth fingers respectively. The cross-members 24 are of a height (dimension away from the inner surface 15) slightly larger than the thickness of the fingers, so as to permit the fingers to be placed loosely between the bands 22 and 25. The length of the band 25 (direction laterally of the glove 10) is preferably slightly greater than the length of the band 22, so that the outside edges of the ends 26, 27 of the band 22 will generally lie along lines drawn respectively from the outside edges of the ends 29, 30 normal to the curved inner surface 15. For ease of construction, the widths (dimension in the direction of the length of the fingers) of the members 24 and band 25 will be the same as the width of the band 22. A glove fashioned in accordance with an embodiment such as shown in FIGS. 1 and 2 may, for example, have a band 22 of approximately 2⅛" length, 7/16" width and 1/16" thickness; a band 25 of approximately 2¾" length, 7/16" width and 1/16" thickness; and three cross-members of approximately 10/16" height, 7/16" width and 1/16" thickness; with appendages 26, 27 of approximately 6/16" and 5/16" lengths, respectively. The corners of the ends 26, 27 are preferably rounded to eliminate sharp points that may inadvertently cause injury.

The glove 10 may be formed as a unitarily molded member in accordance with known protective device manufacturing techniques. The front and rear portions 12, 13 are first formed from a suitable resilient material capable of absorbing energy, such as plastic, polystyrene, polyurethane or polyvinylchloride foam, or a rubber foam, or the like. Contouring to match the general shape of the hand is performed by cutting and joining pieces of the foam material together, with the thickened portion 16 being created by adding supplemental layers of material. The palm and thumb straps 19, 21, which may be cut from a sheet of strengthened plastic web material, are then secured by attachment of enlarged end portions 31, 32 and 33, 34, respectively, at appropriate locations around the opposite side edges of the front portion 13 and thumb portion 20. The gripping means comprising the ladder-like structure shown in FIG. 3 may be of an extruded plastic material and is secured by attachment of the outer face of the base band 25 to the inner surface 15, laterally across the finger portion 17, placing it slightly in, and generally parallel to the forward edge 35 of the glove. The structure thus assembled is then covered with a smooth, surface coating or casing of tough, tear-resistant pliable material, such as polyvinylchloride, to provide a continuous, flexible jacket to prevent tearing of the underlying foam material during use of the glove 10. The coating can be formed over the underlying foam material, webbing and finger grip extrusion by spraying, dipping or other similar known coating application and securing process.

An elastic strap 37 is provided to circumferentially encompass the wrist portion 14 and extend across the inner wrist opening. One end of the strap 37 is fixedly attached to the outer surface 38 of the rear portion 12 and includes one element of a hook and eye fastener 39 to which a matching element 40 located on the free end of the strap 37 may be releasably coupled for securing and retaining the rear portion 12 of the member 11 to the wrist.

The operation of the protective glove 10 is illustrated with reference to FIGS. 6 and 7 which show the glove worn by a hand which is held in the open, extended finger position (FIG. 6) and by a hand which is being brought into a closed fist position (FIG. 7). It will be noted that with the hand in the open position, the foam member 11 is generally contoured to fit over and protect the back of the wrist and hand, including at least the bases of the fingers. The wrist strap 37 is fastened around the rear portion 12 to retain the rear portion 12 in wrist encircling position, open at the inner wrist. The palm strap 19 extends across the upper palm between the thumb and fingers to secure and retain the front portion 13 to the back of the hand, with the side portion 18 covering the blade side of the hand which will serve as the point of contact when a knifehand blow or similar open-handed chop is delivered against an opponent. It is noted that the front edge 41 (top edge in FIG. 6) of the strap 19 runs generally straight along the base of the fingers, while the rear edge 42 (bottom edge in FIG. 6) of the strap 19 is angled forwardly towards the front edge away from the side portion 18 so as to hold the portion 18 against the blade side of the hand without interfering with the movement of the thumb. As shown, the thumb portion 20 partially surrounds the thumb, leaving the inner thumb open, and the thumb strap 21 extends across the inner thumb to retain the thumb portion 20 in position.

With the hand in its open, finger extended position, the fingers are passed between the gripping member 22 and the base band 25, with the band 22 extending laterally of the glove 10 across the front of the middle phalanges of the fingers, from the middle of the first finger to the middle of the fourth finger. The cross-members 24 extend, respectively, alongside the middle phalanges between the first and second, second and third, and third and fourth fingers, respectively, to join the base band 25 which forms an integral part of the inner surface 15 of the finger portion 17. When a fist is made, as shown in FIG. 7, the fingers are curled to bring the fingertips into contact with the palm strap 19. At the same time, the thumb is brought into contact with the back of the fingers. This movement causes the fingers to act on the gripping member 22 and the thumb to act on the strap 21 to tighten the glove about the fist, drawing the front portion 13 toward the rear portion 12 with the thickened portion 16 positioned over the knuckles and the backs of the proximal phalanges of the fingers, to pad the striking surface which is the point of contact for blows delivered with the closed fist.

The free floating ends 26, 27 of the gripping member 22 extend the length of the band 22 laterally beyond the point of connection of the first and third cross members 24 with the member 22, without connecting the ends 26, 27 around the outsides of the first and fourth fingers. This permits all fingers of the fist to be closed around the same width of the band 22 without providing external attachment outside the fingers adjacent opposite edges of the glove which may cause inadvertent eye injury or the like. Moreover, the unconnected free ends 26, 27 which connect laterally beyond the stringers 24 cooperate with the rest of the band 22 and the stringers 24 to enable the stringers to be drawn generally normal to the inner surface 15 when the fist is made to give a more uniform and desirable drawing force distribution to the finger gripping means.

The advantageous force distribution is enhanced by the additional lateral extensions also of the ends 29, 30 of the base band 25 beyond points of the attachment of the first and third cross members 24 to that band 25. Providing attachment to the inner surface 15 on both sides of each cross member 24 assists the cross-members 24 to be pulled perpendicularly to the inner surface 15 when the hand is closed, rather than at an angle; thereby helping to prevent the gripping member 22 from being torn away from the glove.

A modified form of glove 10' is shown in FIG. 8. The glove 10' has a member 11' with a rear portion 12' having a shortened wrist portion 14'. There is no thumb portion 20 as in the glove 10. Instead the edge of the glove 10' opposite a side portion 18' is cut out at 43 to give freedom of movement to the wearer's thumb. An element including a gripping member 22, cross-members 24 and base band 25 is integrally attached to an inner surface 15' of a finger portion 17 to function, as with the previously described glove 10, to draw the member 11' tightly around a formed fist.

It will be appreciated that the gripping means may be modified and, in particular, that the number of cross-members 24 may be reduced, as for example by removing the center member to leave the first and third members, while still realizing some of the advantages of the present invention. It will also be realized that while the improved finger gripping means is presented by way of example as a laterally, extending ladder-like structure, the same may be implemented as one or two loops through which the second and third fingers may be jointly or separately inserted, with portions of the loops running along the fronts of the fingers constituting the gripping member, portions of the loops running alongside the fingers constituting the stringers, and having lateral appendages running partway along the fronts of the first and fourth fingers and being unconnected at their outer extremities to constitute the free floating ends of the gripping member. Those skilled in the art to which the invention relates will, moreover, appreciate that various other substitutions and modifications may also be made to the described embodiments without departing from the spirit and scope of the invention as defined by the claims below.

What is claimed is:

1. A protective glove adapted to fit over and cover the back of the wrist and hand, including the fingers, of a wearer to protect from injury in the art of karate and the like, comprising:

a flexible, resilient foam member having a rear portion and a front portion;

said rear portion including a wrist portion comprising encircling means adapted to partially surround the wrist and open at the inner wrist;

said front portion having an open inner surface generally contoured to match the back of the hand and fingers, and including a thickened portion adapted to cover the knuckles and proximal phalanges, and a finger portion extending downwardly from a forward part of said thickened portion and adapted to cover at least the bases of the fingers when the hand is placed in the glove in a finger extended position;

strap means connected across said front portion transversely of said inner surface and arranged to extend across an upper palm portion between the thumb band the fingers to secure and retain said front portion to the hand; and means located at said finger portion and spaced apart from said strap means, said means comprising an elongated laterally extending gripping member having free floating ends and a plurality of stringers connecting laterally spaced points on said gripping member intermediate said ends to said inner surface with said ends left unconnected, said means being adapted to be grasped with the gripping member extending across the fronts of the fingers and said stringers respectively extending between adjacent fingers, so as to secure and retain said finger portion against the back of the fingers and draw said front portion toward said rear portion by said stringers when the hand is placed in the glove and closed into a fist;

the unconnected free floating ends projecting laterally beyond said stringers to assist the wearer in forming the fist and said ends cooperating with said stringers to draw said stringers generally normal to said inner surface to tighten the glove when the fist is made while permitting unrestricted lateral movement of the fingers adjacent said ends when said glove is tightened; and said glove further comprising means extending across the inner wrist opening of said rear portion for releasably securing and retaining said rear portion to said wrist.

2. A glove as in claim 2, wherein said front portion further comprises a side portion extending downwardly at a non-thumb side of the flexible member and being adapted to cover the blade side of the hand; and wherein said strap means is connected to said side portion.

3. A glove as in claim 2, wherein said flexible member further comprises a thumb portion comprising encircling means adapted to partially surround the thumb and open at the front of the thumb; and said glove further comprises strap means connected across the thumb portion to secure and retain said thumb portion to the thumb.

4. A glove as in claim 1 wherein said means located at said finger portion further comprises an elongated laterally extending base member attached to said inner surface, and wherein said stringers connect said points on said gripping member to said inner surface through the intermediary of said base member.

5. A glove as in claim 4, wherein the stringers connect to said base member at laterally spaced points intermediate the ends of said base member.

6. A glove as in claim 5, wherein said means located at said finger portion further comprises a laterally extending ladder-like structure.

7. A glove as in claim 1, wherein said gripping member comprises a first band adapted to fit within the closed hand across the fronts of the middle phalanges of all four fingers of the hand.

8. A glove as in claim 7, wherein said plurality of stringers comprises a plurality of three cross-members adapted to extend along sides of the middle phalanges of the first and second fingers, second and third fingers, and third and forth fingers, respectively, of the hand.

9. A glove as in claim 8, wherein said means located at said finger portion further comprises a second, elongated, laterally extending band attached to said inner surface and adapted to run across the backs of the middle phalanges of all four fingers of the hand; and wherein said cross-members connect said points on said first band to said inner surface by connection to said second band at laterally spaced points intermediate the ends of said second band.

10. A protective glove adapted to fit over and cover the back of the wrist and hand, including the fingers, of a wearer to protect from injury in the art of karate and the like, comprising:

a flexible, resilient foam member having a rear portion and a front portion;

said rear portion including a wrist portion comprising encircling means adapted to partially surround the wrist and open at the inner wrist;

said front portion having an open inner surface generally contoured to match the back of the hand and fingers, and including a thickened portion adapted to cover the knuckles and proximal phalanges, and a finger portion extending downwardly from a forward part of said thickened portion and adapted to cover at least the bases of the fingers when the hand is placed in the glove in a finger extended position;

strap means connected across said front portion transversely of said inner surface and arranged to extend across an upper palm portion between the thumb and the fingers to secure and retain said front portion to the hand; and a ladder-like member laterally disposed at said finger portion comprising first and second parallel, elongated laterally extending bands spaced from each other, and a plurality of cross-members extending generally perpendicularly to said inner surface and connecting respective points of said first and second bands intermediate their ends, said first band being attached to and forming apart of said finger portion, said second band being raised up in elevated position from said inner surface by said cross-members and said second band being spaced apart from said strap means and having its ends left unconnected as free floating appendages;

said ladder-like member being adapted to be grasped with the second band extending across the fronts of the fingers and said cross-members respectively extending between adjacent fingers, so as to secure and retain said finger portion against the back of the fingers and draw said front portion toward said rear portion by said cross-members when the hand is placed in the glove and closed into a fist;

the unconnected free floating appendages projecting laterally beyond said cross-members to assist the wearer in forming the fist and said appendages cooperating with said cross-members to draw said cross-members generally normal to said inner surface to tighten the glove when the fist is made while permitting lateral movement of fingers beyond the end of said second band when the fist is made; and said glove further comprising means extending across the inner wrist opening of said rear portion for releasably securing and retaining said rear portion to said wrist.

11. A glove as in claim 10, wherein said second band is adapted to fit within the closed hand across the fronts of the middle phalanges of all four fingers of the hand.

12. A glove as in claim 11, wherein said plurality of cross-members comprises a plurality of three cross-members adapted to extend along sides of the middle phalanges of the first and second fingers, second and third fingers, and third and forth fingers, respectively, of the hand.

13. A glove as in claim 12, wherein said first band is adapted to run across the backs of the middle phalanges of all four fingers of the hand.

14. A glove as in claim 13, wherein the ends of said first band have outer edges, and the ends of said second band have outer edges located perpendicularly above said outer edges of said first band relative to said inner surface

15. A glove as in claim 10, wherein said appendages have rounded corners.

16. A protective member adapted to fit over and cover the back of the hand of the wearer to protect from injury, the protective member comprising:

a flexible, resilient foam member having a front portion;

said front portion having an open inner surface generally contoured to match the back of the hand and fingers, including a first portion adapted to cover the knuckles and proximal flanges, and a finger portion extending downward from a forward part of said first portion and adapted to cover at least the bases of the fingers when the hand is placed in the glove and in a finger extended position;

means connected to said front portion for securing and retaining said front portion of said hand;

means disposed at said finger portion and spaced apart form said front portion securing means comprising an elongated bodily extending gripping member having a first and second end and at least one stringer connected on a latterly spaced point on said gripping member intermediate said first and second ends and to said inner surface of said front portion, with at least one of said ends left unconnected, said means being adapted to be grasped with the gripping member extending across the front of the fingers and said stringer respectively extending between adjacent fingers, so as to secure and retain said finger portion against the back of the fingers and draw said front portion to said rear portion by said stringer when hand is placed in the glove and closed in a fist; and the unconnected end projecting latterly beyond the stringer to assist the wearer in forming the fist and said unconnected end cooperating with said stringer to draw said stringer generally normal to said inner surface to tighten the glove when the fist is made while permitting lateral movement of the finger adjacent said free floating end when said glove is tightened.

* * * * *